US008882603B2

(12) United States Patent
Reising et al.

(10) Patent No.: US 8,882,603 B2
(45) Date of Patent: Nov. 11, 2014

(54) PLAYGROUND SAFETY SURFACE

(75) Inventors: Gregory S. Reising, Gary, IN (US); George McGuan, Gary, IN (US); Richard Hagelberg, Gary, IN (US)

(73) Assignee: Kidsoft LLC, Gary, IN (US)

( * ) Notice: Subject to any disclaimer, the term of this patent is extended or adjusted under 35 U.S.C. 154(b) by 0 days.

(21) Appl. No.: 13/587,731

(22) Filed: Aug. 16, 2012

(65) Prior Publication Data

US 2013/0165243 A1 Jun. 27, 2013

Related U.S. Application Data

(60) Provisional application No. 61/524,664, filed on Aug. 17, 2011.

(51) Int. Cl.

| | |
|---|---|
| ***A63C 19/00*** | (2006.01) |
| ***E01C 13/04*** | (2006.01) |
| ***E01C 13/06*** | (2006.01) |
| *E01C 13/08* | (2006.01) |

(52) U.S. Cl.

CPC ..... *E01C 13/06* (2013.01); *E01C 13/045* (2013.01)

USPC ..... 472/92; 472/94; 428/17; 404/32

(58) Field of Classification Search

CPC ..... A63K 1/00; A63K 3/046; A63K 13/08; A63K 13/02; E01C 1/04; E01C 9/086; E01C 13/08; A63C 19/00; C04B 14/06; C04B 16/04; C08L 23/16; C08L 2666/06

USPC ..... 472/85–87, 92, 94; 428/17; 404/1, 32, 404/36

See application file for complete search history.

(56) References Cited

U.S. PATENT DOCUMENTS

| | | | | |
|---|---|---|---|---|
| 4,948,116 | A | 8/1990 | Vaux | |
| 5,085,424 | A | 2/1992 | Wood, Jr. | |
| 5,183,438 | A | 2/1993 | Blom | |
| 5,525,416 | A | 6/1996 | Katz et al. | |
| 5,618,131 | A * | 4/1997 | Weber | 404/32 |
| 5,823,711 | A * | 10/1998 | Herd et al. | 405/36 |
| 5,829,081 | A * | 11/1998 | Pearce | 5/654 |
| 6,071,039 | A | 6/2000 | Ogura et al. | |
| 6,221,445 | B1 | 4/2001 | Jones | |
| 6,287,049 | B1 | 9/2001 | Keinholz | |
| 6,796,096 | B1 | 9/2004 | Heath | |
| 6,966,841 | B1 * | 11/2005 | Sherman | 472/89 |
| 7,943,213 | B2 * | 5/2011 | Weber et al. | 428/17 |

* cited by examiner

*Primary Examiner* — Kien Nguyen

(74) *Attorney, Agent, or Firm* — Marshall, Gerstein & Borun LLP

(57) ABSTRACT

A safety surface for use over a supporting base in a designated area of a playground includes a bottom layer arranged for placement over the supporting base, a plurality of mesh bags, each of the mesh bags filled with a plurality of pieces of a shock absorbent material, and a border arranged for placement along selected edges of the designated area. The mesh bags are sized and shaped to abut adjacent mesh bags, with a portion of the mesh bags arranged to abut the border. And internal divider is positioned in an interior of the mesh bags, with the internal divider arranged to divide the interior of the mesh bags into a plurality of interior compartments. A top layer is arranged to overlie the mesh bags and arranged for securement to the border.

15 Claims, 9 Drawing Sheets

PLAYGROUND SAFETY SURFACE

FIELD OF THE INVENTION

The present invention relates generally to playground systems. More specifically, the present invention relates to a safety surface for use with playground systems and to playgrounds incorporating such a safety surface.

BACKGROUND

Most modern playgrounds have some form of shock absorbent safety surface intended to reduce the risk of injury. The industry has developed a number of different safety surfaces, including, for example, chipped wood products, resilient rubber foam, shredded tires, and poured-in-place rubberized surfaces.

Unfortunately, some existing safety surfaces may be prone to one or more drawbacks. For example, some applications, such as chipped wood products, absorbent rubber foam, and shredded tires offer favorable shock absorption qualities, but some of the softer options lack stability. As a result, the shock absorbent material tends to migrate away from high traffic areas, leaving many high traffic areas of a playground unprotected. On the other hand, many poured-in-place surfaces are very stable and thus not subject to migration, but these more stable options are often harder than desired. It can be difficult to find the proper balance between stability and shock absorption, and thus many playgrounds can benefit from an improved surface that offers favorable shock absorption as well as resistance to migration.

SUMMARY

In accordance with one exemplary aspect, a safety surface for use over a supporting base in a designated area of a playground comprises a bottom layer arranged for placement over the supporting base, a plurality of mesh bags, each of the mesh bags filled with a plurality of pieces of a shock absorbent material, and a border arranged for placement along selected edges of the designated area. The mesh bags are sized and shaped to abut adjacent mesh bags, with a portion of the mesh bags arranged to abut the border. And internal divider is positioned in an interior of the mesh bags, with the internal divider arranged to divide the interior of the mesh bags into a plurality of interior compartments. A top layer is arranged to overlie the mesh bags and arranged for securement to the border.

In accordance with one or more preferred forms, the top layer may be formed from a plurality of tiles, connectors may be provided to connect adjacent tiles one another. Further, a connection may be provided for attaching edges of selected tiles to the border. Adjacent bags may be arranged to abut one another along a generally vertical interface, such that the interface and the internal divider cooperate to inhibit migration of the shock absorbent material.

In accordance with another exemplary aspect, a safety surface for use over a supporting base in a designated area of a playground comprises a water permeable bottom layer sized and shaped for placement over the supporting base, a border arranged for placement along selected edges of the designated area, and a plurality of mesh bags, each of the mesh bags forming an interior, with an internal divider positioned in the interior, the internal divider arranged to divide the interior into a plurality of compartments. Each of the compartments is filled with a plurality of pieces of a shock absorbent material, and the mesh bags are sized and shaped for placement adjacent to one another so as to abut any adjacent mesh bags along an interface. One exemplary shock absorbent fill material is commonly referred to as rubber mulch. The border is positioned to abut an edge portion of the mesh bags positioned adjacent to the border, and a top layer arranged to overlie the mesh bags and arranged for securement to the border. Consequently, the internal divider, the top layer and the border cooperate to inhibit lateral migration of the shock absorbent material.

In accordance with yet another preferred form, the disclosed system may include an anti-cut layer beneath the top layer, which anti-cut layer may take the form of a wire mesh or grid, a Kevlar mesh, grid, or layer, or any other suitable material offering cut resistance. Further, the system may include an anti-abrasion layer over the bags.

In accordance with another exemplary aspect, a safety surface for use over a supporting base in a designated area of a playground comprises a plurality of mesh bags, each of the mesh bags filled with a plurality of pieces of a shock absorbent material, the mesh bags being arranged for placement over the supporting base. A border may be arranged for placement along selected edges of the designated area. The mesh bags may be sized and shaped to abut adjacent mesh bags, a portion of the mesh bags being arranged to abut the border. At least some of the mesh bags may include at least one an internal divider positioned in an interior of the at least some mesh bags, the internal divider being arranged to divide the interior of the at least some mesh bags into a plurality of interior compartments. A top layer may be arranged to overlie the mesh bags and may be arranged for placement adjacent to the border.

In accordance with yet another preferred form, the disclosed system may include a top layer that is formed from a plurality of tiles, the top layer having a connector arranged to connect one tile to an adjacent tile along a seam. Further, the disclosed system may include at least one connector having a first portion that is arranged for placement along the seam and beneath the tiles, and a second portion that is arranged for placement along the seam and above the tiles. Still further, the disclosed system may include at least one internal divider having a pair of internal panels forming three compartments, each of the three compartments including a pair of top sections positioned to meet along a top seam. Still further, the disclosed system may include adjacent bags that are arranged along a generally vertical interface, the interface and the internal divider cooperating to inhibit migration of the shock absorbent material.

BRIEF DESCRIPTION OF THE DRAWINGS

FIGS. 5A-5D are enlarged views of a fourth exemplary form of a mesh bag for containing a quantity of loose shock absorbent material.

DETAILED DESCRIPTION OF THE INVENTION

Although the following text sets forth a detailed description of one or more exemplary embodiments of the invention, the legal scope of the present invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, and these alternatives would still fall within the scope of the claims defining the full scope of the invention.

Figure 1:
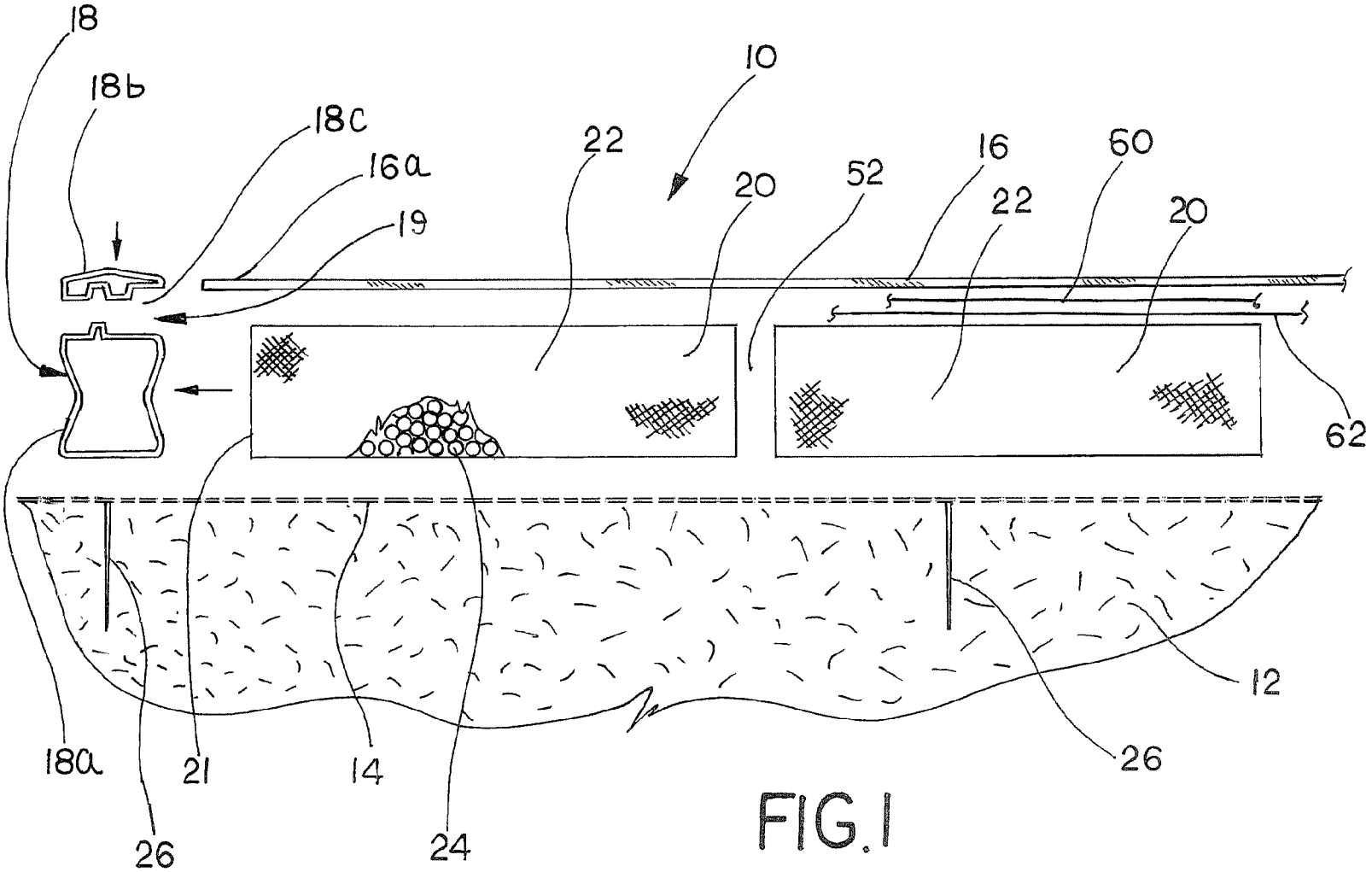
FIG. 1 is cross-sectional view, partially exploded, of a playground safety surface assembled in accordance with the teachings of the present invention and incorporating a fabric layer over a base, plurality of mesh bags containing a quantity of loose shock absorbent material, a top layer, and a manufactured border.
Figure 2:
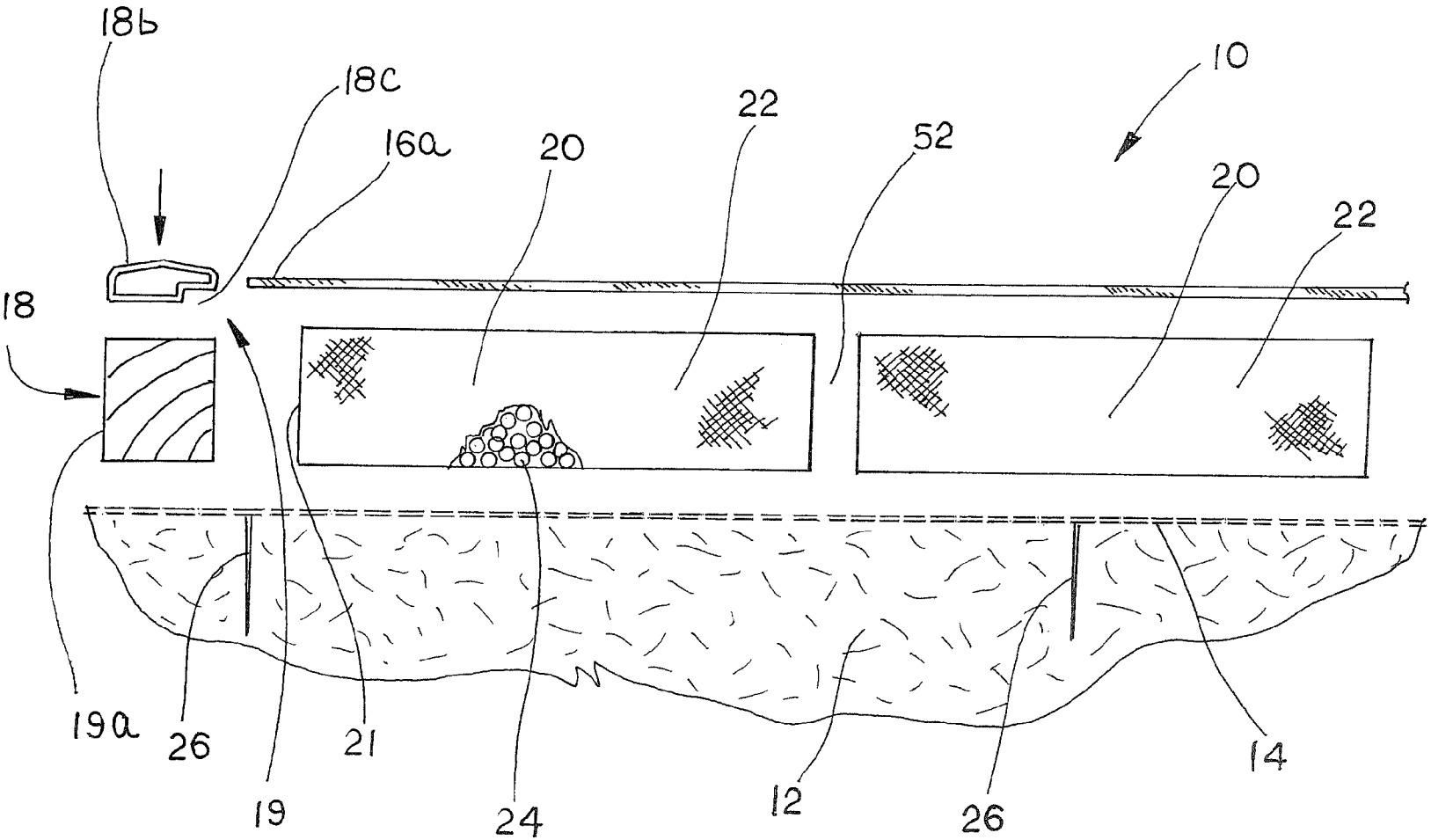
FIG. 2 is another cross-section of view, similar to FIG. 1, but illustrating a milled timber border.
Figure 3B:
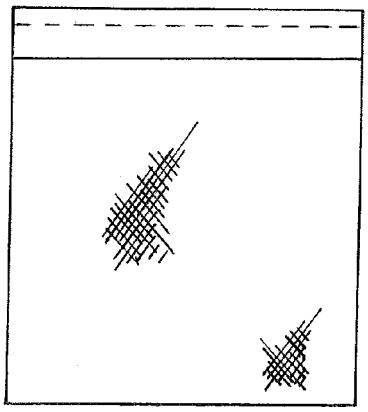
FIGS. 3A-3D are enlarged views of a first exemplary form of a mesh bag for containing a quantity of loose shock absorbent material for use with the disclosed safety surface.
Figure 3C:
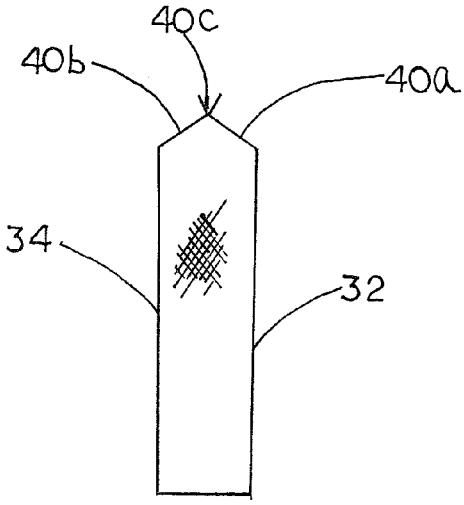
Figure 3D:
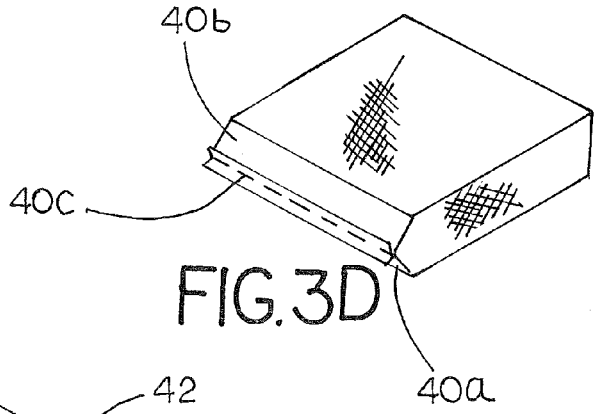
Figure 3A:
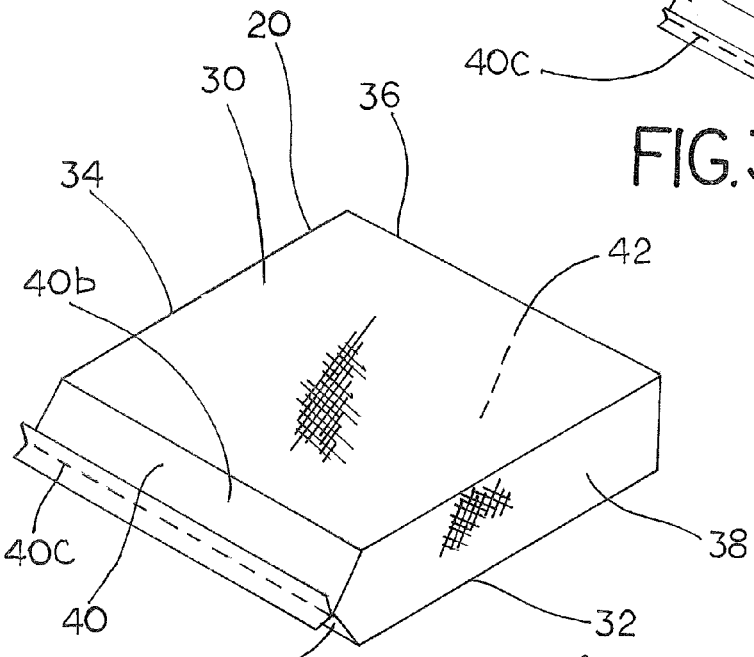
Figure 4B:
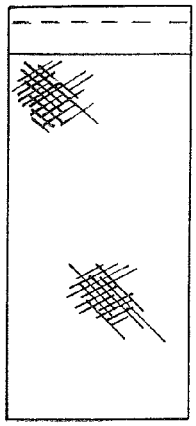
FIGS. 4A-4D are enlarged views of a second exemplary form of a mesh bag for containing the quantity of loose shock absorbent material.
Figure 4C:
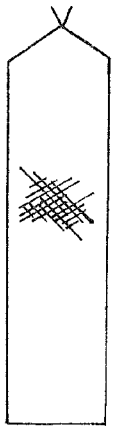
Figure 4D:
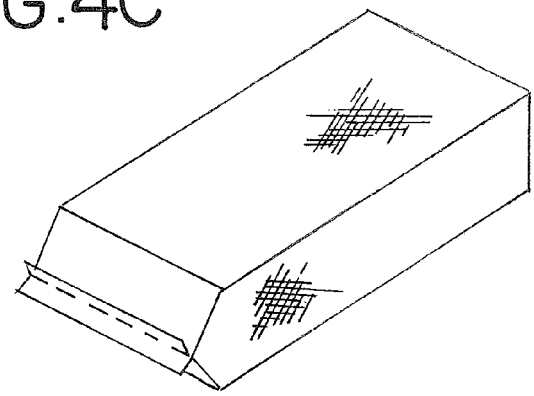
Figure 4A:
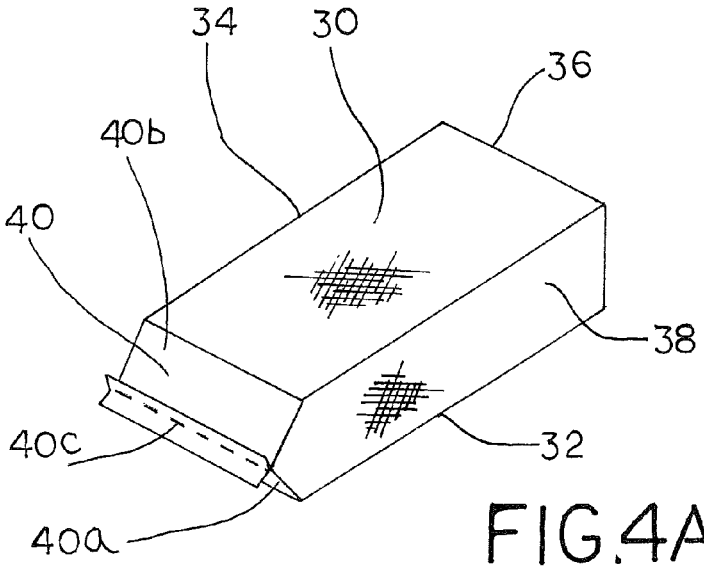
Figure 5B:
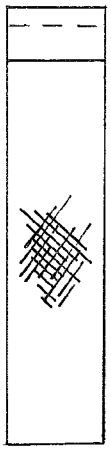
FIGS. 5A-5D are enlarged views of a third exemplary form of a mesh bag for containing a quantity of loose shock absorbent material.
Figure 5C:
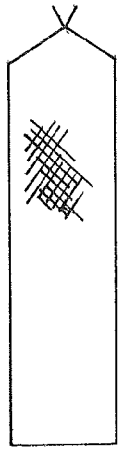
Figure 5A:
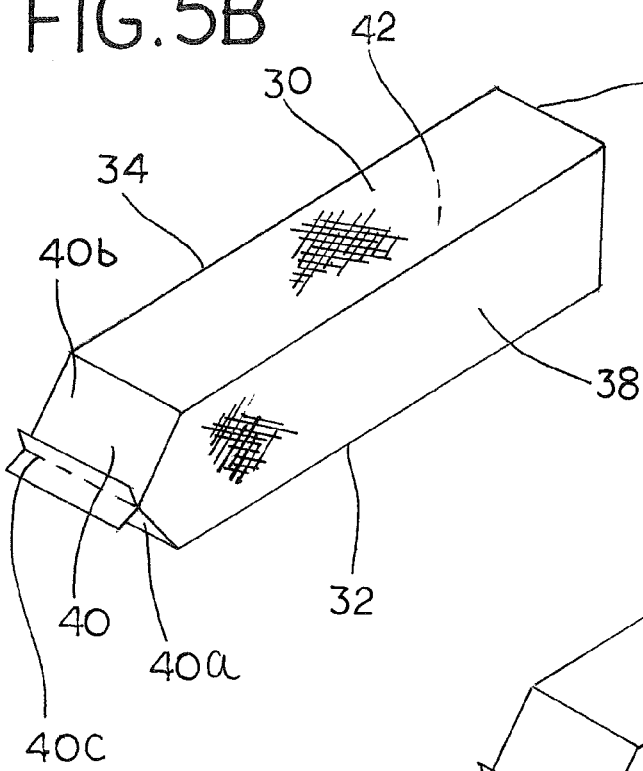
Figure 5D:
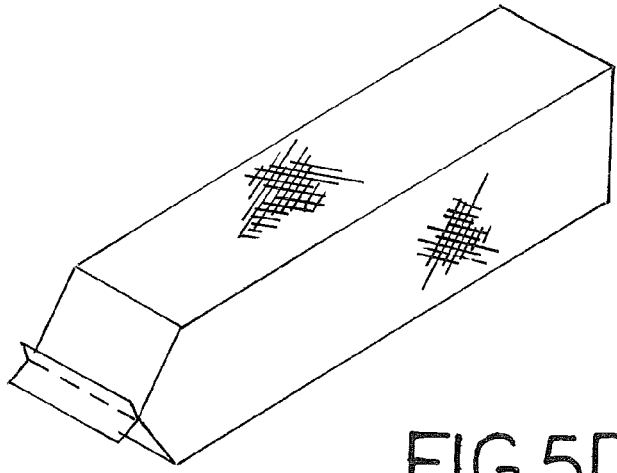

Referring now to the drawings, FIGS. 1 and 2 illustrates a playground safety surface 10 assembled in accordance with the teachings of a first disclosed example of the present invention. The safety surface 10 is disposed over a prepared base 12 of the type commonly employed in the industry, such as, for example, compacted gravel or other suitable aggregate. Those of skill in the art will understand that the base 12 may be constructed of any other suitable material. The safety surface 10 includes a lower layer 14, a top layer 16, and a border 18. FIG. 1 illustrates a border 18 formed from a manufactured section 18*a* having a removable cap 18*b*, while FIG. 2 illustrates a border 18 formed from a milled wood section 19*a* having a removable cap 18*b*. In all other respects, the examples of FIG. 1 and FIG. 2 are substantially identical. The removable cap 18*b* provides an area 18*c* sized to receive an adjacent edge portion 16*a* of the top layer, forming a suitable connection 19 between the top layer 16 and the border 18. A plurality of bags 20 is disposed over the lower layer 14 and beneath the top layer 16, and the bags 20 are filled with shock absorbent material 22. Preferably, the bags 20 are placed so as to abut one another, and further are place such that at least some of the bags 20 are disposed along an edge 21 so as to abut the border 18. In accordance with the disclosed example, the shock absorbent material 22 is formed from a quantity of discrete pieces 24 (only a portion of the discrete pieces 24 are shown in FIGS. 1 and 2). The shock absorbent material 22 may be a shock absorbent foam, shredded tires, or any other suitable material. The bags 20 preferably are formed from any material that permits the bags to be water permeable and relatively flexible. A polymer coated mesh may be preferred, although other mesh materials, coated or uncoated, such as a polypropylene mesh or a nylon mesh material, may prove suitable. Still other materials may prove suitable.

Preferably, the lower layer 14 is a geotextile fabric, which is water permeable. A number of commercially available geotextile fabrics may prove suitable. The lower layer 14 may be suitably secured to the base 12 using a plurality of anchors 26 at suitable intervals. The top layer 16 preferably is formed from a plurality of tile sections 28 (a number of which are shown to advantage in FIG. 8). The tile sections 28 are preferably formed of a UV resistant material and preferably are also water permeable. As an alternative, a separate UV resistant layer may be provided under the top layer 16. As a further alternative, the top layer may be formed from a continuous roll of material instead of using discrete tile sections.

Referring now to FIGS. 3A-3D, 4A-4D, 5A-5D and 6A-6B, the bags 20 may be constructed in a variety of sizes so as to foster full coverage over the designated playground area, and to facilitate easy placement around supporting poles and other components of the playground equipment. In the examples of FIGS. 3A-3D, 4A-4D, 5A-5D, the bags include a top 30, a bottom 32, and four sides 34, 36, 38 and 40, all of which cooperate to surround an interior 42. As shown, the side 40 includes two panels 40*a* and 40*b* which meet along a seam 40*c*, which permit the side 40 to open up for filling. The seam 40*c* may be left open, or it may be sealed. In any event, the bags 20 may come in any suitable size and/or shape in order to facilitate placement around equipment.

Figure 6A:
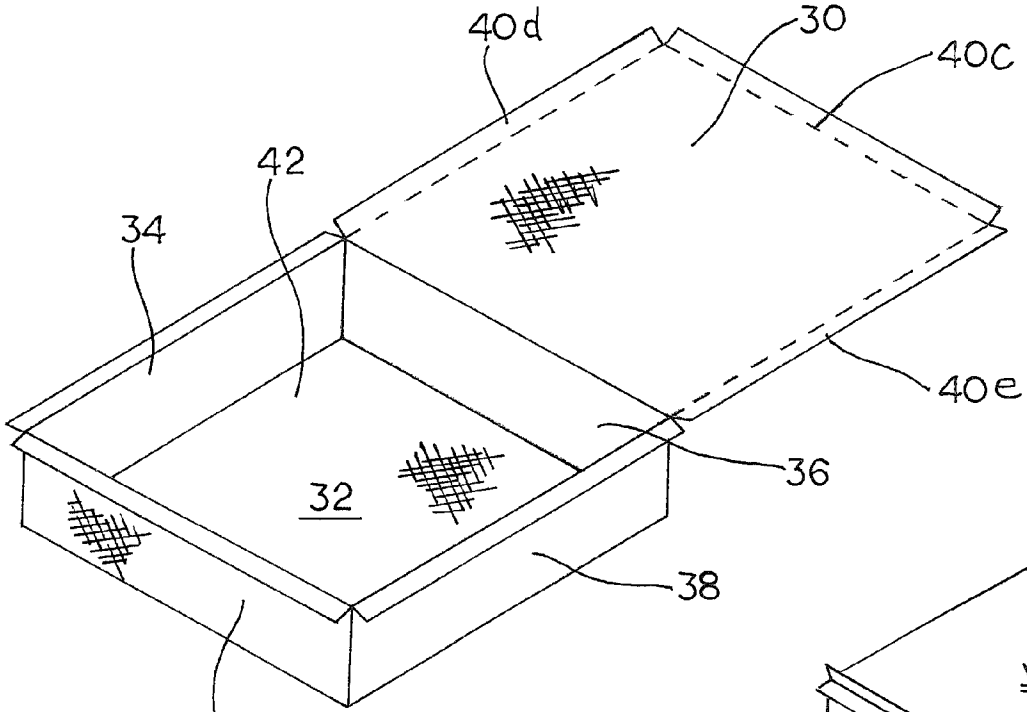
FIGS. 6A-6B are enlarged views of a fifth exemplary form of a mesh bag for containing a quantity of loose shock absorbent material.
Figure 6B:
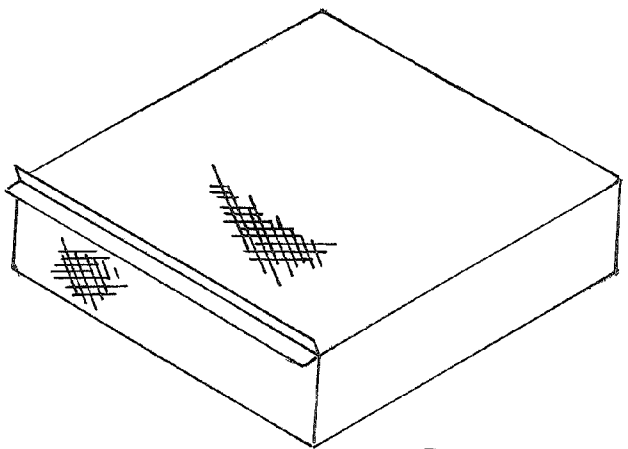

Preferably, the bags 20 are placed to abut one another, and to abut the surrounding border 18 in a manner similar to placing brick pavers. As shown in FIGS. 6A and 6B, the bags 20 also may be formed such that the sides 34, 36, 38 and 40 are all continuous, but with the top 30 forming a panel that permits access to the interior of the bag 20 for filling. Again, the top may be sealed along the three edges 40*c*, 40*d* and 40*e* if desired, using any suitable means, such as heat sealing, RF welding, adhesives, fasteners, hook and loop closures, etc.

Figure 7:
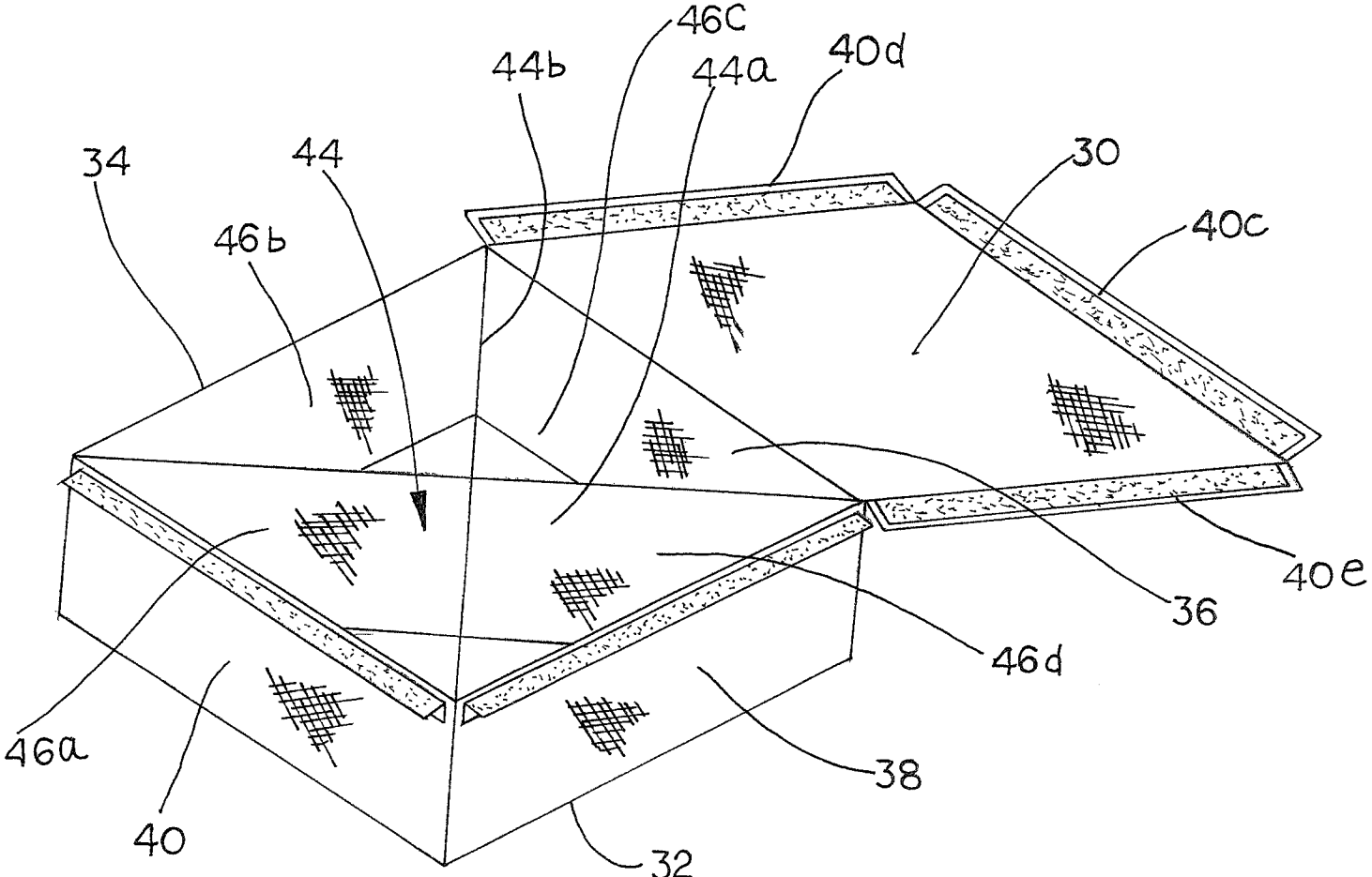
FIG. 7 is enlarged view of a sixth exemplary form of a mesh bag for containing a quantity of loose shock absorbent material, and illustrating a plurality of internal dividers which divide an interior of the disclosed mesh bag into a plurality of compartments.

Referring now to FIG. 7, any one of the foregoing bags may optionally include a divider system 44 including a number of panels 44*a* and 44*b* which, in the example shown, divide the interior 42 into four (4) compartments 46*a*, 46*b*, 46*c* and 46*d*. The divider panels 44*a* and 44*b* preferably are constructed from the same material that forms the other portions of the bags 20.

Figure 8:
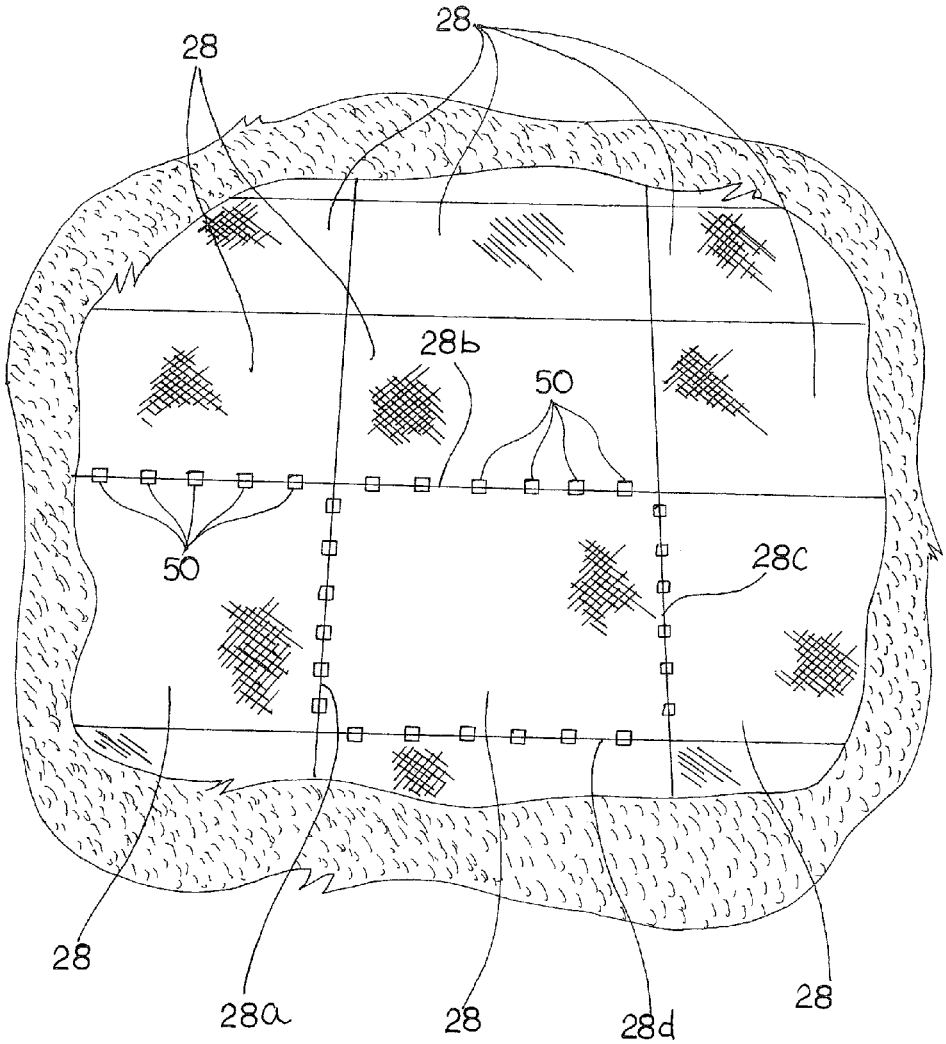
FIG. 8 is a perspective view from above illustrating an exemplary top layer formed from a plurality of interconnected sections.

Referring now to FIG. 8, each of the tile sections 28 includes a plurality of edges 28*a*, 28*b*, 28*c* and 28*d*. In the example shown, a plurality of connectors 50 is provided to facilitate attachment of the edges of adjacent tiles to one another. In one exemplary embodiment, at least one of the connectors 50 may include a first portion arranged for placement along the seam and beneath the tiles, and a second portion arranged for placement along the seam and above the tiles.

Figure 9:
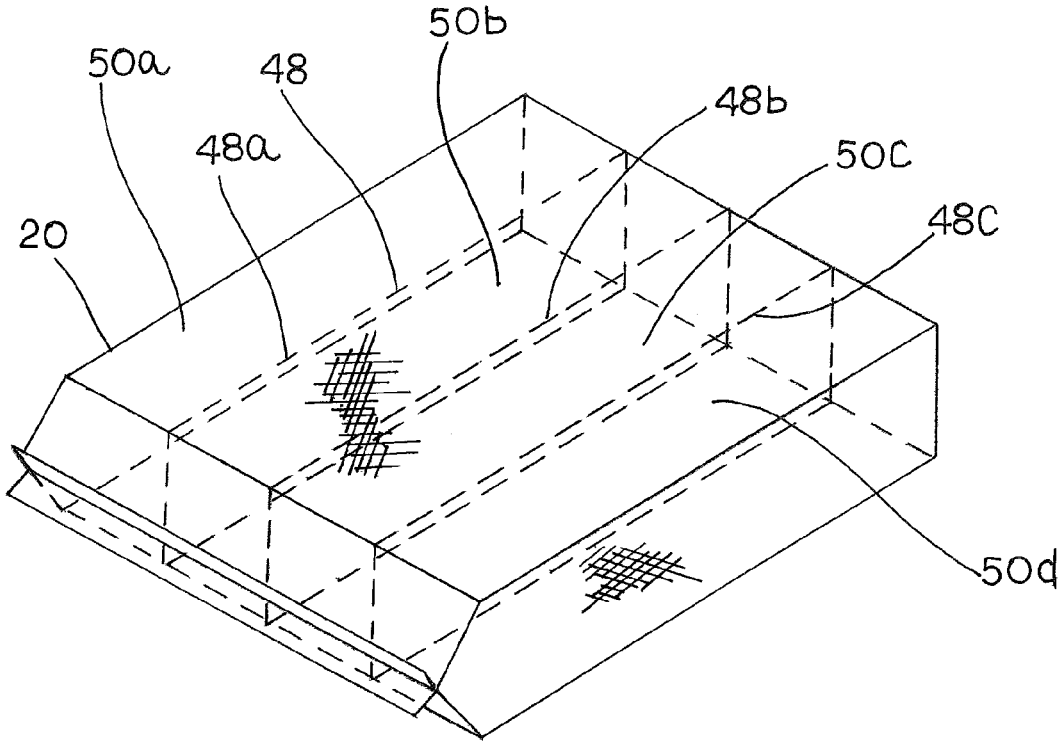
FIG. 9 is enlarged view of a yet a further exemplary form of a mesh bag for containing a quantity of loose shock absorbent material, and illustrating a plurality of internal dividers which divide an interior of the disclosed mesh bag into a plurality of compartments, and showing a pair of mesh end sections or panels which open to receive the shock absorbent material and close to contain the material.

Referring now to FIG. 9, another exemplary bag is shown, which is similar in many respect to the bag of FIGS. 3A through 3D, except that the bag of FIG. 9 includes an internal divider system 48 having a number of parallel panels 48*a*, 48*b* and 48*c*, dividing the interior 50 into four (4) compartments 50*a*, 50*b*, 50*c* and 50*d*. The divider panels preferably are constructed from the same material that forms the other portions of the bags 20.

Any and all dimensions shown or referred to herein are to be regarded as exemplary only and, unless expressly recited in a specific one of the appended claims, are not intended to expressly or inherently limit the scope of any of the other appended claims in any way.

In accordance with one or more aspects of the disclosed examples, when the safety surface 10 is assembled at a designated area on a playground, the bags 20 are positioned to abut adjacent bags such that the bags effectively brace one another via contact along a generally vertical interface 52 (shown in FIGS. 1 and 2) between adjacent bags. This contact between adjacent bags, in conjunction with the surrounding border, inhibits lateral and/or vertical migration of the pieces of the shock absorbent material. The addition of the internal dividers within the bags that divide the interior into compartments further act to limit lateral and/or vertical migration of the pieces 24 of the shock absorbent material 22.

Referring again to FIG. 1, the disclosed safety surface 10 may include an anti-cut layer 60 beneath the top layer 16. The anti-cut layer 60 may take the form of a wire mesh or grid, a Kevlar mesh, grid, or layer, or any other suitable material offering cut resistance. The anti-cut layer 60 offers additional protection for the bags 20 against vandalism, for example, by inhibiting or limiting a vandals ability to make a longitudinal cut along the top portion of any one of the bags 20. As an alternative, the anti-cut layer 60 may be incorporated into the tile sections 28. Further, the system may include an anti-abrasion layer 62 over the bags 20. The anti-abrasion layer 62 may be constructed of any suitable fabric. Only a portion of the layers 60 and 62 are shown in FIG. 1, but those of skill in the art will understand that one or both layers may be included under the entire safety surface, or under only selected portions of the safety surface.

Those of skill in the art, upon reading the present disclosure, will understand that the teachings outlined herein may be applied to an entire playground area, to selected areas within a playground, or only to selected high traffic areas of a playground. Those of skill in the art will also understand that, although certain dimension may be shown in the attached drawings, the dimensions ultimately may be chosen by the designer in order to meet the specific needs of a particular application.

The preceding text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

What is claimed:

1. A safety surface for use over a supporting base in a designated area of a playground, the safety surface comprising:

a bottom layer arranged for placement over the supporting base;

a plurality of mesh bags, each of the mesh bags filled with a plurality of pieces of a shock absorbent material;

a border arranged for placement along selected edges of the designated area;

the mesh bags sized and shaped to abut adjacent mesh bags, a portion of the mesh bags arranged to abut the border;

an internal divider positioned in an interior of the mesh bags, the internal divider arranged to divide the interior of the mesh bags into a plurality of interior compartments;

a top layer arranged immediately adjacent the mesh bags and arranged for placement adjacent the border.

2. The safety surface of claim 1, wherein the top layer is formed from a plurality of tiles, and including connectors to connect adjacent tiles one another.

3. The safety surface of claim 2, including a connection for attaching edges of selected tiles to the border.

4. The safety surface of claim 1, wherein adjacent bags are arranged along a generally vertical interface, and wherein the interface and the internal divider cooperate to inhibit migration of the shock absorbent material.

5. The safety surface of claim 1, wherein the top layer directly contacts the mesh bags.

6. The safety surface of claim 5, wherein the top layer is formed from a plurality of tiles and includes a connector arranged to connect each tile to an adjacent tile along a seam, wherein the connector includes a first portion arranged for placement along the seam and beneath the tiles, and a second portion arranged for placement along the seam and above the tiles.

7. The safety surface of claim 1, wherein the border is formed from a first portion and a second portion removably disposed on the first portion.

8. A safety surface for use over a supporting base in a designated area of a playground, the safety surface comprising:

a water permeable bottom layer sized and shaped for placement over the supporting base;

a border arranged for placement along selected edges of the designated area, the border being formed from a first portion and a second portion removably disposed on the first portion;

a plurality of mesh bags, each of the mesh bags forming an interior;

an internal divider system positioned in the interior, the internal divider system arranged to divide the interior into a plurality of compartments;

each of the compartments filled with a plurality of pieces of a shock absorbent material;

the mesh bags sized and shaped for placement adjacent to one another so as to abut any adjacent mesh bags along an interface;

the border positioned to abut an edge portion of the mesh bags positioned adjacent to the border; and a top layer arranged to overlie the mesh bags and arranged for securement to the border;

wherein the internal divider, the top layer and the border cooperate to inhibit lateral migration of the shock absorbent material.

9. The safety surface of claim 8, wherein the divider system comprises a pair of internal panels forming three compartments.

10. The safety surface of claim 9, wherein each of the three compartments includes a pair of top sections positioned to meet along a top seam.

11. The safety surface of claim 8, wherein the border includes a recess formed in the second portion, the recess sized to receive an adjacent edge portion of the top layer.

12. A safety surface for use over a supporting base in a designated area of a playground, the safety surface comprising:

a plurality of mesh bags, each of the mesh bags filled with a plurality of pieces of a shock absorbent material, the mesh bags arranged for placement over the supporting base;

a border arranged for placement along selected edges of the designated area;

the mesh bags sized and shaped to abut adjacent mesh bags, a portion of the mesh bags arranged to abut the border;

at least some of the mesh bags including at least one an internal divider positioned in an interior of the at least some mesh bags, the internal divider arranged to divide the interior of the at least some mesh bags into a plurality of interior compartments;

a top layer arranged to overlie the mesh bags and arranged for placement adjacent to the border, the top layer being formed from a plurality of tiles and including connectors arranged to connect one tile to an adjacent tile along a seam, wherein the connectors include a first portion arranged for placement along the seam and beneath the tiles, and a second portion arranged for placement along the seam and above the tiles.

13. The safety surface of claim 12, wherein the internal divider comprises a pair of internal panels forming three compartments.

14. The safety surface of claim 13, wherein each of the three compartments includes a pair of top sections positioned to meet along a top seam.

15. The safety surface of claim 12, wherein adjacent bags are arranged along a generally vertical interface, and wherein the interface and the internal divider cooperate to inhibit migration of the shock absorbent material.

* * * * *